US005536538A

United States Patent [19]

Hartung

[11] Patent Number: 5,536,538

[45] Date of Patent: Jul. 16, 1996

[54] ARTIFICIAL CHRISTMAS TREE

[76] Inventor: Kenneth A. Hartung, Rte. 5, Box 571, Bedford, Pa. 15522

[21] Appl. No.: 399,528

[22] Filed: Mar. 7, 1995

[51] Int. Cl.[6] ..... A47G 33/06

[52] U.S. Cl. ..... 428/12; 428/18; 428/20

[58] Field of Search ..... 428/18, 12, 19, 428/20

[56] References Cited

U.S. PATENT DOCUMENTS

| | | | |
|---|---|---|---|
| 1,654,427 | 12/1927 | Modlarz | 428/12 X |
| 2,708,324 | 5/1955 | Wedden | 428/12 X |
| 2,913,843 | 11/1959 | Wittick | 428/18 X |
| 3,819,459 | 6/1974 | Wren | 428/18 X |
| 3,865,676 | 2/1975 | Bogart et al. | 428/20 |
| 4,020,201 | 4/1977 | Miller | 428/20 X |
| 4,140,823 | 2/1979 | Weskamp | 428/20 X |

*Primary Examiner*—Henry F. Epstein
*Attorney, Agent, or Firm*—Peter A. Borsari

[57] ABSTRACT

The present invention relates to an artificial Christmas tree which can be assembled on virtually any surface, including an uneven surface, and then adjusted to a true vertical position. The artificial Christmas tree comprises a vertical trunk member secured to a swivel base, a plurality of side arms, a plurality of bottom arms and a locking arrangement which enables the side arms and bottom arms to be quickly and easily detachably connected to the vertical trunk member and to each other. Once assembled, the artificial Christmas tree can be adorned with Christmas decorations, such as strings of Christmas lights by means of a fastening system located on each side arm. The artificial Christmas tree of the present invention is particularly useful for outdoor use since it can assembled on uneven ground and then adjusted to a true vertical position. The locking arrangement further allows the artificial Christmas tree to be simply folded upon itself for storage.

17 Claims, 6 Drawing Sheets

12
11a
10
20
20
30
30
13
14
18
17
18
19
16
15
16
19

FIG. 6
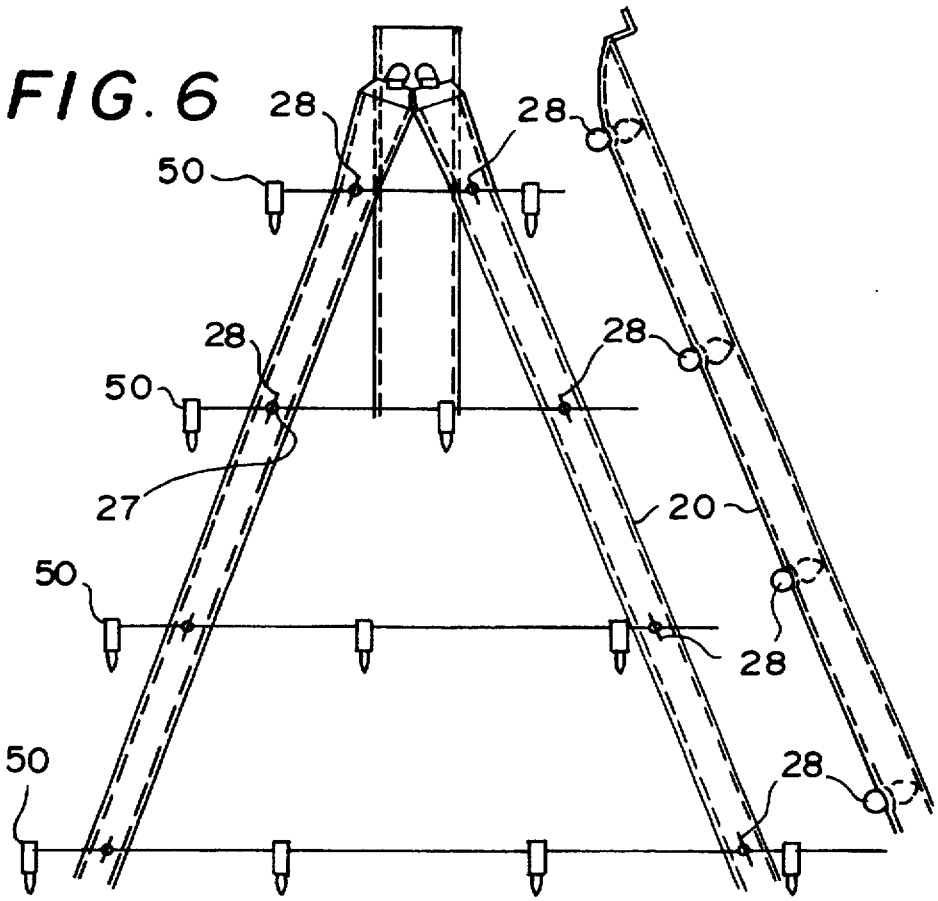
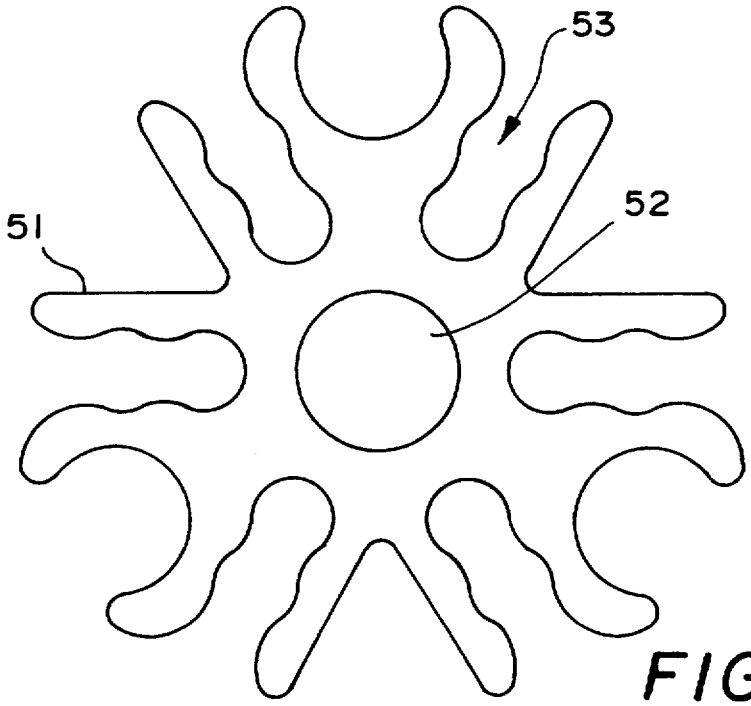
FIG. 7

ARTIFICIAL CHRISTMAS TREE

FIELD OF INVENTION

The present invention relates to an artificial Christmas tree which can be assembled on virtually any surface, including an uneven surface, and then adjusted to a true vertical position. The artificial Christmas tree comprises a vertical trunk member secured to a swivel base, a plurality of side arms, a plurality of bottom arms and a locking arrangement which enables the side arms and bottom arms to be quickly and easily detachably connected to the vertical trunk member and to each other. Each side arm also is equipped with means for fastening Christmas decorations, particularly strings of Christmas lights, to the assembled tree. After use, the artificial Christmas tree can be easily disassembled and folded upon itself for compact storage.

BACKGROUND OF THE INVENTION

During the period between the Thanksgiving and Christmas holidays, there is a flurry of activity as people begin to decorate their homes, yards, offices and even towns in celebration of the holidays. Among the more popular decorations are the stringing of lights around trees and shrubs and the erecting of cut or artificial Christmas trees. The assembly of these decorations is not always an easy task and often becomes a tedious chore. For example, a common dilemma faced by the casual homeowner when putting up a Christmas tree is trying to position the tree perpendicularly in order to achieve a true vertical position. This problem is even more acute when the homeowner attempts to assemble an artificial Christmas tree on uneven ground as an outdoor decoration. Often, outdoor artificial Christmas trees are difficult to assemble and raise to a true vertical position. Another quandary faced by the homeowner is keeping the strings of lights on the trees The prior art discloses numerous types of artificial Christmas trees for indoor and/or outdoor use. However, these artificial trees are not constructed in a manner which would allow one to spike the tree in uneven ground and then easily adjust the tree to a true vertical position. For example, U.S. Pat. No. 3,865,676 to Bogart et al. discloses an artificial tree construction wherein a post of a standard tree trunk is provided with limb assemblies having an elongated column or spine member. At a plurality of locations along the back or bottom well of the spine member, there are formed pairs of gripping fingers or clips. The top of the trunk is provided with a large opening that forms a tongue and notch system for retaining the frame struts or arms.

In U.S. Pat. No. 1,654,427 to Modlariz, an artificial Christmas tree is disclosed comprising a trunk having a straight vertical staff of cylindrical form. A plurality of equally spaced rods of resilient wire have their upper ends adjacent and secured to the trunk and are tensioned to spring inwardly. When set up for use, means are provided for releasably maintaining the rods in an outwardly spread downwardly diverging relation, such as by radial rods hinged at their outer ends to the lower ends of the rods. U.S. Pat. No. 3,819,459 to Wren discloses an artificial tree assembly having a plurality of angular elements supported on and attached to a base member to define at least a portion of a cone. The angular members include (1) arms which extend radially from the base member and (2) upright strut members which extend upwardly and inwardly from the outer end of the arm members to the apex of the cone. A plurality of electrical light bulbs are threaded into the arm members and upright strut members. A foldable Christmas tree is disclosed in U.S. Pat. No. 4,140,823 to Weskamp comprising a tubular member or trunk collar for retaining branches. The trunk collar has a U-shaped configuration for receiving branch connecting arms.

Although the prior art is replete with indoor and outdoor artificial Christmas trees, all these devices have limitations or disadvantages associated therewith including, for example, (1) the amount of material used, (2) then length of time required to assemble the Christmas tree, (3) the inability to adjust the Christmas tree to its true vertical position, (4) the inability to secure the Christmas tree on uneven ground, (5) the degree of difficulty of assembling the Christmas tree, (6) the relative expense of the Christmas tree, (7) the difficulty and length of time required to dismantle the Christmas tree, and (8) the relatively large amount of space required to store the tree when not in use.

Despite the teachings of the prior art, a need still exists for an artificial Christmas tree, especially for outdoor use, which can be safely anchored to an uneven surface and adjusted to a true vertical position. Such an artificial Christmas tree should be relatively inexpensive, simple to assemble and easy to disassemble and store in a compact manner.

SUMMARY OF THE INVENTION

Accordingly, it is an object of the present invention to provide an artificial Christmas tree which can be assembled on virtually any surface, including an uneven surface and then easily adjusted to its true vertical position.

It is another object to provide an artificial Christmas tree which can be assembled outdoors on uneven ground and then adjusted perpendicularly to obtain a true vertical position.

It is a further object to provide an artificial Christmas tree which requires a relatively short amount of time to assemble.

It is also an object of the present invention to provide an artificial Christmas tree which can be firmly anchored on uneven ground.

It is an additional object of the present invention to provide an artificial Christmas tree which has means to secure Christmas decorations and strings of lights thereto.

It is still another object of the present invention to provide an artificial Christmas tree which is constructed of light weight material and is relatively inexpensive to manufacture.

It is a further object of the present invention to provide an artificial Christmas tree which can be disassembled in a quick and efficient manner.

It is still another object of the present invention to provide an artificial Christmas tree which can be disassembled by folding upon itself for compact storage.

Additional objects, advantages and novel features of the invention will be set forth in part of the description which follows, and in part will become apparent to those skilled in the art upon examination of the following specification or may be learned by practice of the invention.

These and other objects of the invention, as embodied and broadly described herein, are achieved by providing an artificial Christmas tree comprising a) a vertical trunk member having a base flange stamping at the bottom and a second trunk flange stamping attached above said flange stamping; b) side arms detachably connected to the top of said trunk; c) bottom arms detachably connected to said trunk flange stamping; and d) a locking arrangement for detachably connecting said side arms to said bottom arms.

BRIEF DESCRIPTION OF THE DRAWINGS

The present invention will be better understood with reference to the appended drawing sheets, wherein:

FIG. 6 is a perspective view of the artificial Christmas tree have a string of lights connected thereto.

FIG. 7 is a perspective view of a spider lock.

DETAILED DESCRIPTION

The present invention relates to an artificial Christmas tree which can be assembled on virtually any surface, including an uneven surface, and then adjusted to a true vertical position, and offers particular utility for outdoor use. The artificial Christmas tree comprises a vertical trunk member secured to a swivel base, a plurality of side arms, a plurality of bottom arms and a locking arrangement for quickly and easily detachably connecting the side arms and bottom arms to the vertical trunk member and to each other. The side arms of the artificial Christmas tree also are provided with a fastening system which can be adorned with Christmas decorations, such as strings of Christmas lights. The locking arrangement of the present invention not only provides a means for detachably connecting the side arms and bottom arms to the vertical trunk, but also allow the tree to be folded upon itself for compact storage after use.

Figure 1:
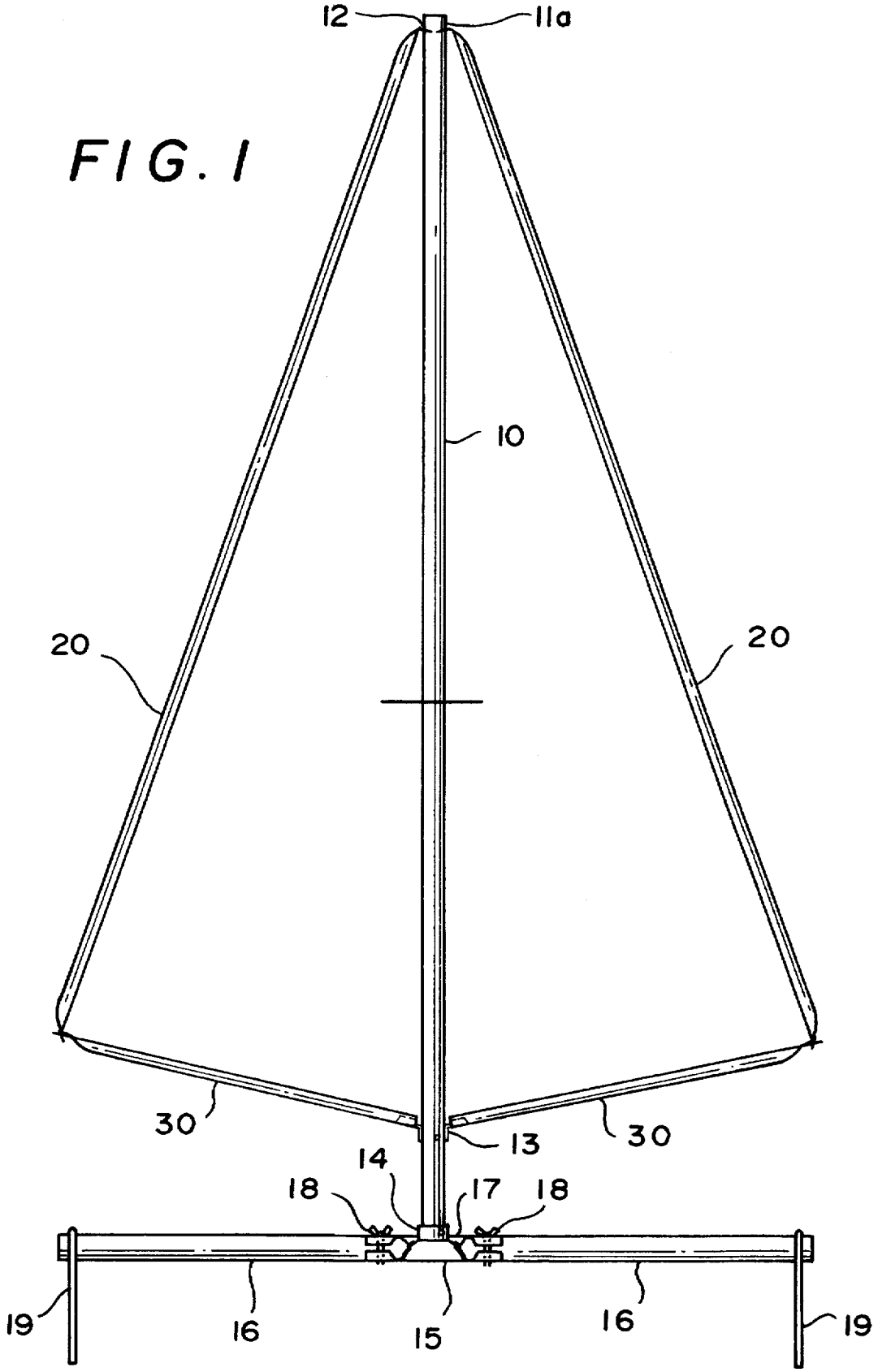
FIG. 1 is a perspective view of the artificial Christmas tree in an assembled position.

As shown in FIG. 1, the artificial Christmas tree, sometimes hereinafter referred to as "the Christmas tree" or "the tree", comprises a vertical trunk member 10, side arms 20, and bottom arms 30. Preferably, the trunk, side arms and bottom arms are constructed of metal tubing. Other suitable materials for construction of the trunk, side arms and bottom arms include, for example, rigid plastic materials, such as polyvinylchloride. For the purposes of this invention, it will be understood that any firm rigid material, as will be recognized by practitioners in the art, is suitable for use in the present invention. The vertical trunk member 10 comprises a top end 11*a* and a bottom end 11*b*. A flange stamping 14, hereinafter sometimes referred to as the "base flange stamping" or simply the "base stamping" secures the bottom end lib of the trunk to a swivel base.

Figure 2A:
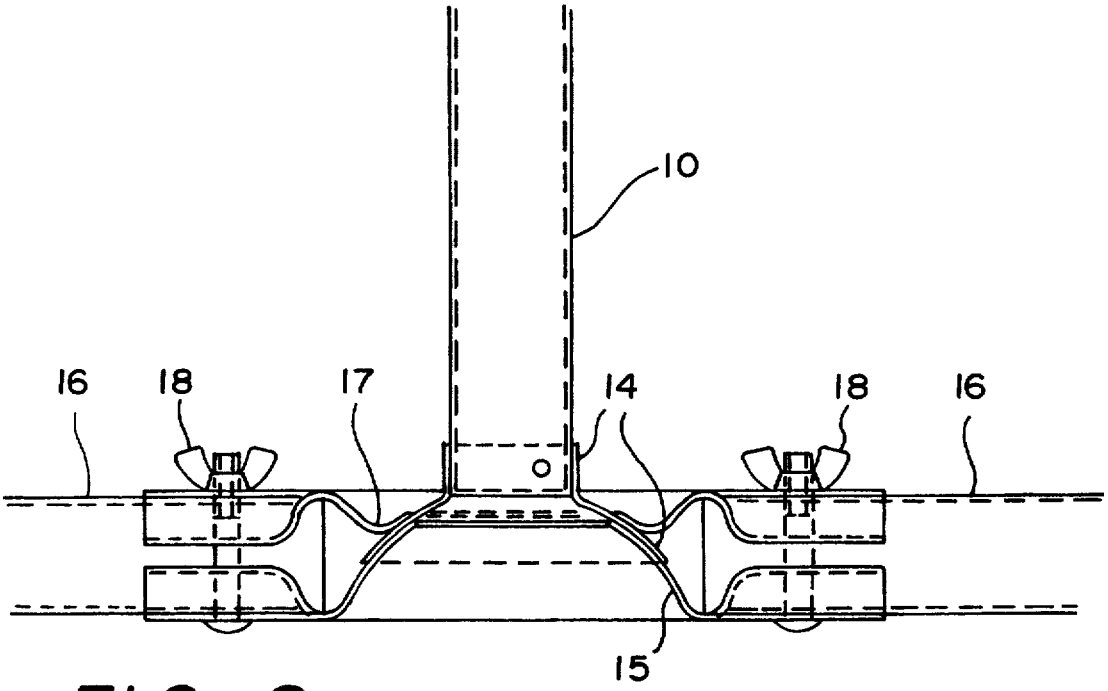
FIG. 2*a* is a perspective view of the swivel base.
Figure 2B:
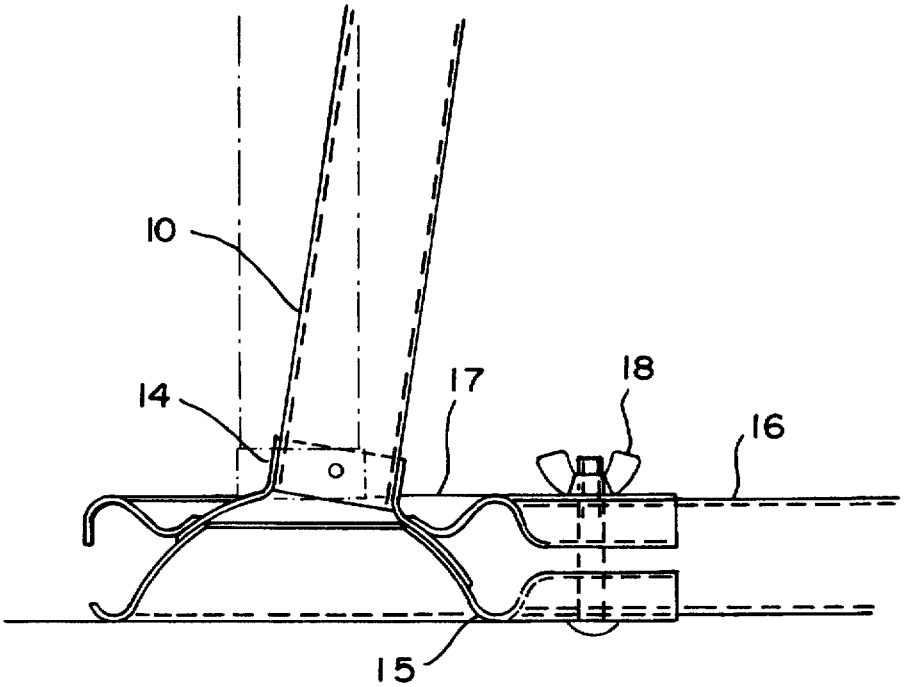
FIG. 2*b* is a perspective view of the swivel base in operation.

More specifically, as shown in FIGS. 2 and 2*b*, the swivel base comprises a base member 15, a cover member 17, a plurality of leg members 16 and a clamping system 18, such as a conventional nut-and-bolt arrangement. The proximal end of each leg member 16 is installed between the base member 15 and cover member 17 and secured into position by the clamping system. The trunk member 10 is secured to the swivel base by positioning the bottom end 11*b* within the base stamping 14 and thereafter clamping the lower tanged portion of the base stamping between the spherical bulge of base member 15 and the spherical area of the cover member 17 of the swivel base. In this manner, the base stamping 14 is able to slide between the base member 15 and the cover member 17, thereby providing the vertical trunk member 10 with a rotating or tilting motion for swivelling the trunk for perpendicular alignment. Once the desired vertical position has been obtained, the trunk 10 can be locked into position by means of the clamping system 18. Each leg member 16 can be anchored to the ground by means of U-shaped spikes 19 which straddle each leg member and are driven into the ground, thereby insuring that the tree is firmly secured to the ground. In the preferred embodiment shown in FIG. 2, the clamping system is a conventional nut-and-bolt arrangement. In this embodiment, the proximal end of each leg member is provided with a pre-drilled hole which corresponds to holes in the base member and cover member. Once the holes in each leg member are aligned with the corresponding holes in the base member and cover member, bolts are inserted therethrough and tightened with nuts.

Figure 3:
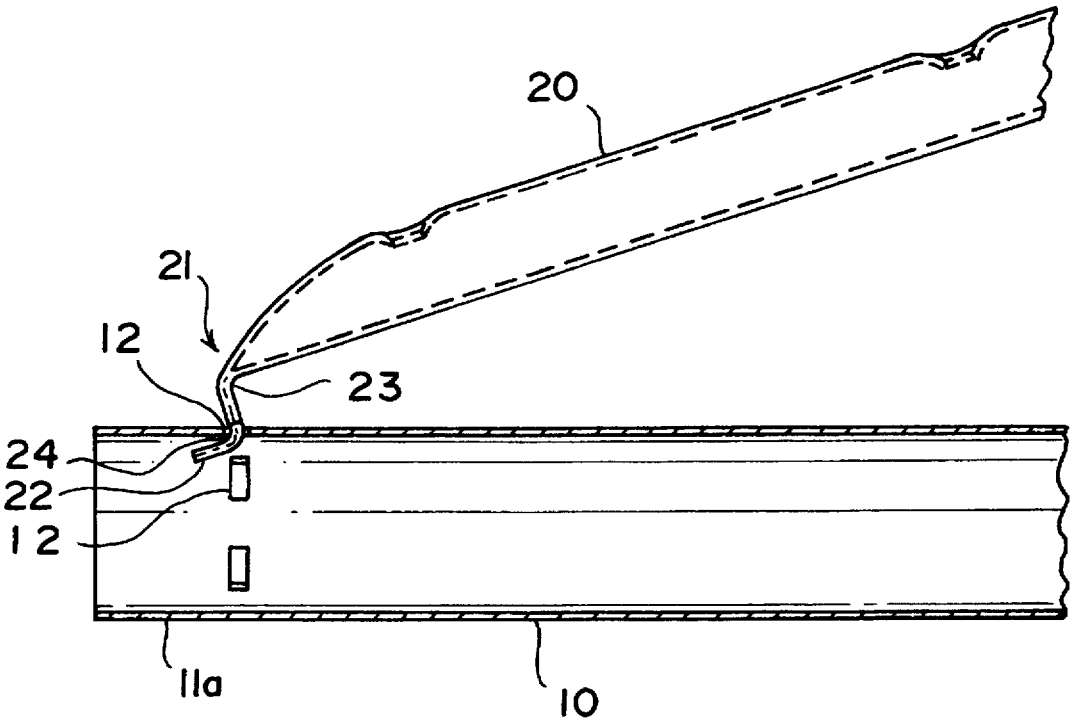
FIG. 3 shows the locking arrangement of the trunk and side arms.

The top end 11*a* of vertical trunk member 10 is provided with a number of slots 12 about the periphery thereof. The number of slots 12 correspond to the number of side arms 20; preferably the top end 11*a* is provided with at least three slots and more preferably, the top end 11*a* is provided with six slots. As shown in FIG. 3, one end of side arm 20, denoted upper end 21, is flattened and notched to form a tongue 22. The flattened end is bent at 23 to an angle of 90° and the tongue 22 is bent at 24 to an angle of 90° to form an L-shaped tip, perpendicular to the side arm 20. The side arm 20 is detachably connected to the top end 11*a* of the vertical trunk member by insertion of the tongue 22 into one of said slots 12. Once the tongue 22 is inserted into a slot 12, the remaining portion of the L-shaped tip provides a locking arrangement, giving side arm 20 a hinge type of effect.

Figure 4:
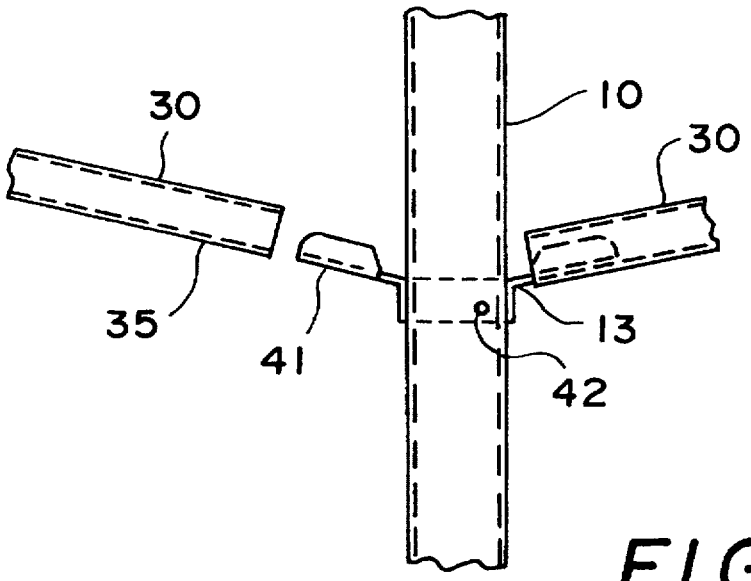
FIG. 4 shows the locking arrangement of the bottom arms and the trunk through the trunk flange stamping.

As shown in FIG. 4, the vertical trunk member 10 also comprises a second stamping 13, hereinafter referred to as "the trunk stamping", positioned between the top end 11*a* of said trunk and the base stamping 14. The trunk stamping 13 comprises a collar 40 and a number of U-shaped prongs 41. The number of prongs 41 correspond to the number of bottom arms 30; preferably the collar 41 is provided with at least three prongs and more preferably, the collar 41 is provided with six prongs. It also should be understood that the number of bottom arms should equal the number of side arms. The trunk stamping 13 is provided for detachably connecting each bottom arm 30 to the vertical trunk member 10. More specifically, as shown in FIG. 4, each bottom arm 30 is constructed with at least one hollow end, denoted inner end 35. The U-shaped prong 41 is configured in such a manner to fit snugly into inner end 35 of bottom arm 30. To detachably connect the bottom arm 30 to trunk 10, the inner end 35 is inserted over the prong 41. The trunk stamping 13 may be secured to the vertical trunk member 10 at any desired position between the top end and the base stamping that is aesthetically pleasing, and preferably is positioned slightly above the base stamping 14. Once positioned, the trunk stamping 13 may be secured in place by the use of one or more screws 42. However, it is to be understood that other securing means well known in the art can also be used.

Figure 5A:
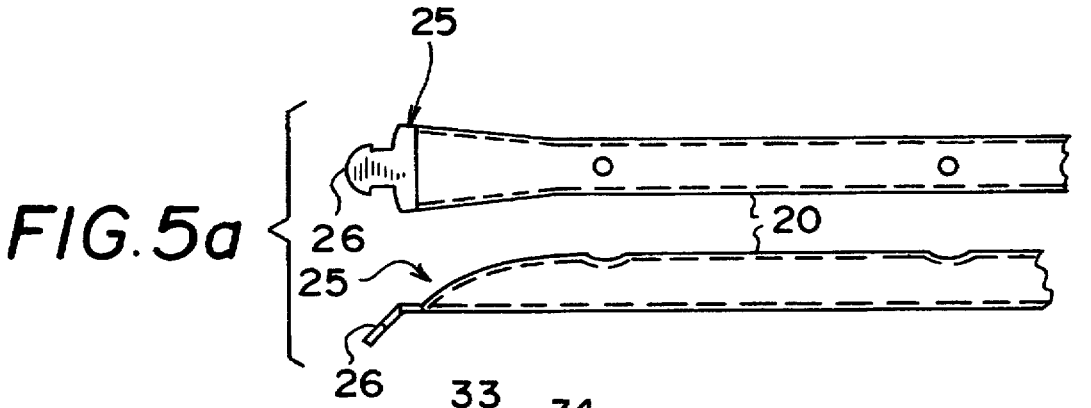
FIG. 5*a* shows the tongue configuration of the side arm's lower end.
Figure 5B:
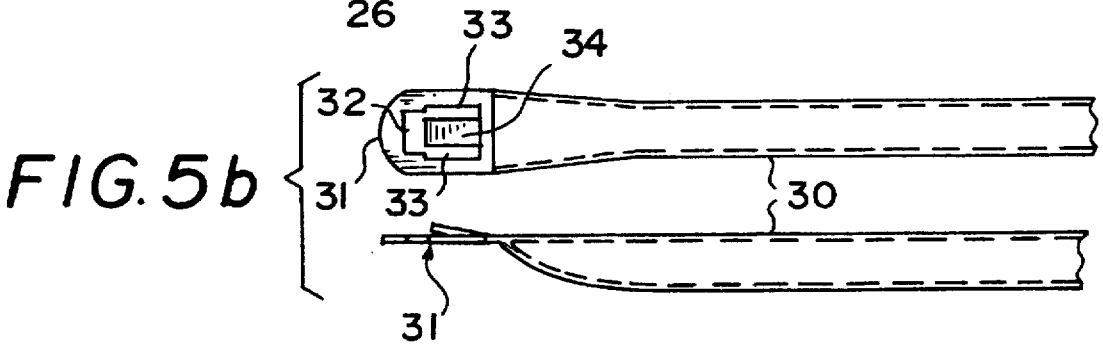
FIG. 5*b* shows the tongue configuration of the bottom arm's outer end.
Figure 5C:
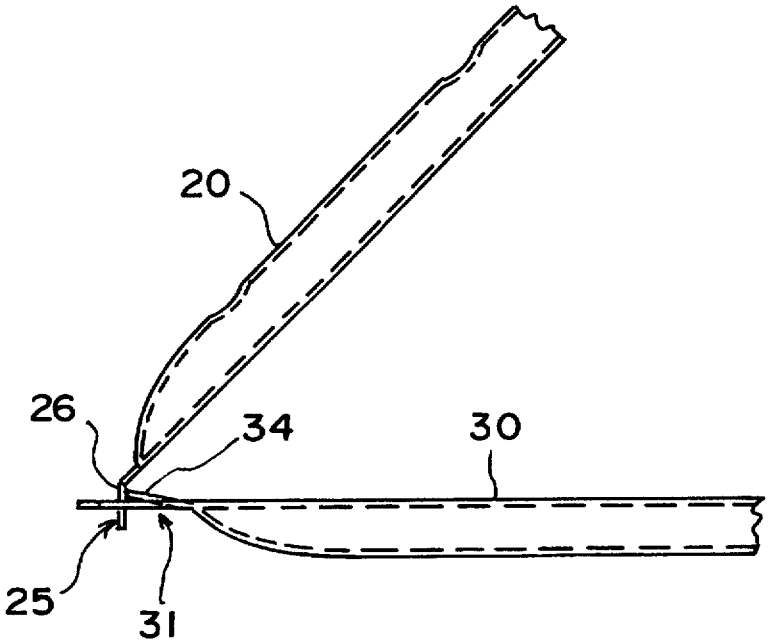
FIG. 5*c* shows the locking arrangement of the side and bottom arms.

As shown in FIGS. 5*a*, 5*b* and 5*c*, each side arm 20 is detachably connected to a corresponding bottom arm 30. Referring to FIG. 5*a*, the distal end of side arm 20, denoted lower end 25 is flattened and notched to form a tongue 26. The tongue is configured in such a manner that it widens at its terminal end, thereby creating a shoulder and is bent downwardly. Referring to FIG. 5*b*, the distal end of bottom arm 30, denoted outer end 31, is flattened and rounded off and is provided with a U-shaped cutaway slot 32 such that a tongue 34 is formed within the outer end 31. The tongue 34 is bent upwards at a slight angle. The side arm 20 is detachably connected to a corresponding bottom arm 30 by urging tongue 26 of side arm 20 under tongue 34 of bottom arm 30 until tongue 26 is pressed and locked into the rectangular section of cutaway slot 32 of bottom arm 30. Once the tongue 26 is secured within the cutaway slot 32, the two arms are joined together in a hinge-like arrangement. This locking arrangement ensures that side arm 20 will be retained within the cutaway slot 32 because of the shoulder on tongue 26. Each side arm 20 can be easily detached from the corresponding bottom arm 30 by reversing the above-described procedure.

As shown in FIG. 6, once the side arms 20 and bottom arms 30 are secured to the vertical trunk, a conical shape is formed about the trunk 10. Each side arm is provided with a plurality of fastening means for attaching Christmas decorations or other adornments thereto. In the preferred embodiment shown in FIG. 6, each side arm 20 is provided with a series of holes 27, each hole having a spring wire clip 28 inserted therein. To each of the spring wire clips 28, a decoration may be fastened. Preferably, the spring wire clips 28 are used to hold one or more strings of Christmas lights 50. In this manner several strings of Christmas lights 50 can be wound around the tree and held in place by the wire clips 28 on the side arms 20.

Figure 8:
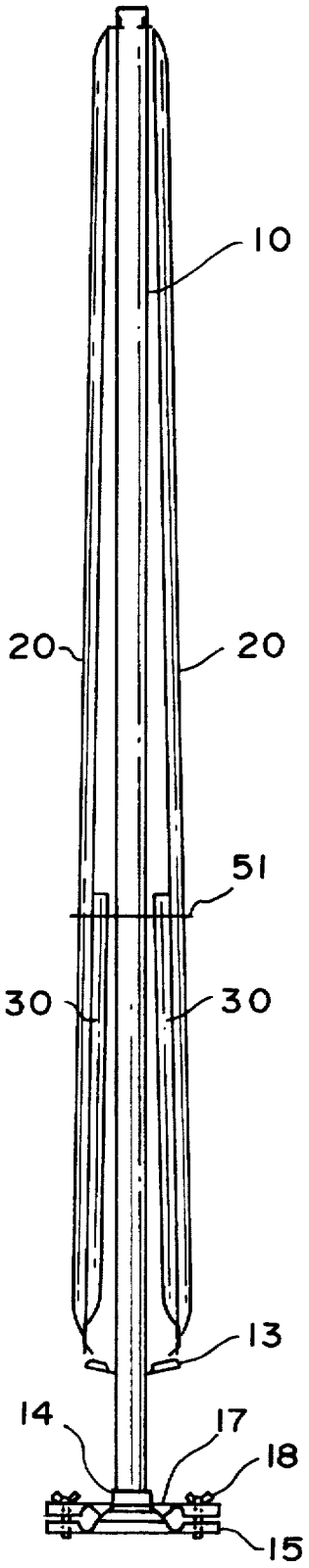
FIG. 8 is a perspective view of the artificial Christmas tree in a disassembled position.
Figure 9:
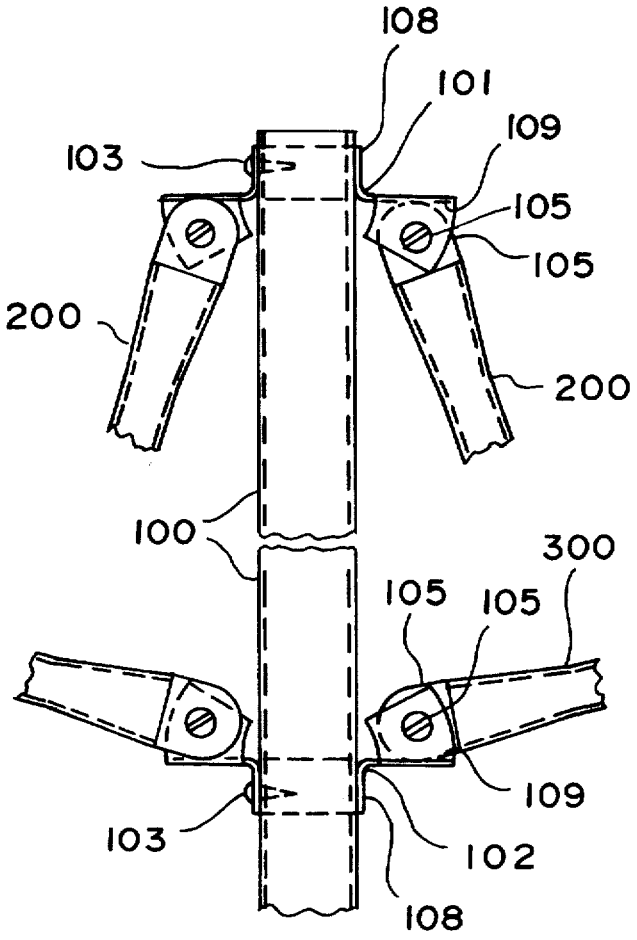
FIG. 9 is a perspective view of an alternate locking arrangement of the present invention.

As shown in FIGS. 7 and 8, the artificial Christmas tree of the present invention may be folded upon itself for compact storage. Referring to FIG. 7, a spider lock 51 is provided for locking the side arms and bottom arms to the trunk. The spider lock is a flat piece of material, such as a durable plastic material, having a center hole 52 and a plurality of notches 53, the number of notches 53 corresponding to the number of side arms 20. More specifically, the tree is disassembled by first loosening the clamping means 18 and removing the leg members 16. The lower end of the trunk then is inserted through the center hole 52 of the spider lock 51. Each bottom arm 30 is pulled off of a prong 41 and folded upwardly and parallel to the corresponding side arm 20. Thereafter, each side arm 20 is folded downwardly towards and parallel to the trunk member 10. As each set of side arms and bottom arms are folded towards the trunk 10, it can be snapped into one of the notches 53 of spider lock FIG. 9 shows an alternate embodiment of the locking arrangement of present invention. More particularly, FIG. 9 depicts a vertical trunk member 100 comprising side arms 200, bottom arms 300, a top flange stamping 101 and a trunk stamping 102. The proximal ends of side arms 200 and bottom arms 300 are flattened and provided with a centerhole such that they can be secured to stamping 101 and 102 respectively by the simple use of screws as the fastening means. Each stamping comprises a collar 108 and several flanges 109. The number of flanges corresponds to the number of side arms; preferably six flanges are provided. At the end of each flange 109, a tab 105 is lanced out perpendicularly. Each tab 105 includes a centerhole for the purposes of inserting screws. In this manner the centerhole of a tab is aligned with the centerhole of a corresponding flattened end, the screws inserted and securely fastened.

While particular embodiments of the invention have been described, it will be understood, of course, that the invention is not limited thereto and that many obvious modifications and variations can be made, and that such modifications and variations are intended to fall within the scope of the appended claims.

What is claimed is:

1. An artificial Christmas tree comprising:

(a) a vertical trunk member having a top end, a bottom end, a base flange stamping located at said bottom end, and a trunk flange stamping located above said bottom end, said trunk member secured to a swivel base by means of said base flange stamping;

(b) a plurality of side arms each having an upper end and a lower end, said upper end of each side arm being detachably connected to said top end of the vertical trunk member;

(c) a plurality of bottom arms each having an inner end and an outer end, said inner end of each bottom arm being detachably connected to said trunk flange stamping;

(d) a locking arrangement for detachably connecting the lower end of each side arm with the outer end of a bottom arm.

2. The artificial Christmas tree according to claim 1, wherein said swivel base comprises a base member, a cover member, a plurality of leg members and a clamping system.

3. The artificial Christmas tree according to claim 2, wherein said base flange stamping and one end of each leg member is clamped between said base member and said cover member.

4. The artificial Christmas tree according to claim 3, wherein a plurality of U-shaped spikes are used to anchor each leg member to the ground.

5. The artificial Christmas tree according to claim 1, wherein said top end of said vertical trunk member comprises a plurality of slots corresponding to the number of side arms and wherein said trunk flange stamping comprises a plurality of prongs corresponding to the number of bottom arms.

6. The artificial Christmas tree according to claim 5, wherein the upper end of each side arm is configured with a flattened tongue in such a manner that it can be introduced into a slot in order to detachably connect said side arm to said top end of the vertical trunk member.

7. The artificial Christmas tree according to claim 5, wherein the inner end of each bottom arm is configured in such a manner that it can inserted over a prong in order to detachably connect said bottom arm to said trunk flange stamping.

8. The artificial Christmas tree according to claim 1, wherein said lower end of said side arm is configured with a flattened and notched tongue and said outer end of said bottom arm is flattened and configured with a U-shaped cutaway slot forming a tongue portion.

9. The artificial Christmas tree according to claim 8, wherein said locking arrangement comprises introducing the tongue of the lower end of the side arm under the tongue portion of the bottom arm.

10. The artificial Christmas tree according to claim 1, further comprising a top flange stamping located at said top end of the vertical trunk member, wherein said upper end of each side arm is detachably connected to said top flange stamping.

11. The artificial Christmas tree according to claim 10, wherein each side arm is detachably connected to said top flange stamping by screw means.

12. The artificial Christmas tree according to claim 1, wherein said inner end of each bottom arm is detachably connected to said trunk flange stamping by screw means.

13. The artificial Christmas tree according to claim 1, wherein said locking arrangement comprises screw means.

14. The artificial Christmas tree according to claim 1, wherein said side arms further comprise a plurality of fastening means for attaching Christmas decorations and strings of Christmas lights.

15. The artificial Christmas tree according to claim 14, wherein said fastening means comprises a plurality of holes each having a spring wire clip inserted therein.

16. The artificial Christmas tree according to claim 1, wherein said tree can be folded upon itself for compact storage, said folding comprising the following steps:

(a) introducing a spider lock having a plurality of notches and a centerhole about the bottom end of said trunk member;

(b) detaching said bottom arms from trunk flange stamping and folding said bottom arms upwardly and parallel to said side arms;

(c) folding said side arms downwardly and parallel to said trunk member; and (d) snapping each side arm into one of said notches in said spider lock.

17. An artificial Christmas tree comprising:

(a) a vertical trunk member having a top end, a bottom end, a base flange stamping located at said bottom end of said vertical trunk member and a trunk flange located above said bottom end;

(b) a swivel base comprising:

(1) a base member having a plurality of holes about the periphery thereof;

(2) a cover member having a plurality of holes about the periphery thereof, said base flange stamping being slidably mounted between said cover member and said base member;

(3) a plurality of leg members, each of said leg members having a proximal end and a distal end, said proximal end being provided with a pre-drilled hole which is configured in such a manner that when said proximal end of each leg member is installed between said base member and cover member, said pre-drilled hole is in alignment with one of said plurality of holes of said base member and also is in alignment with one of said plurality of holes of said cover member; and (4) a clamping system in the form of a nut and bolt arrangement for securing each leg member between said base member and said cover member;

(c) a plurality of side arms, each of said side arms having an upper end and a lower end, said upper end of each of said side arms being detachably connected to said top end of said vertical trunk member;

(d) a plurality of bottom arms, each of said bottom arms having an inner end and an outer end, said inner end of each of said bottom arms being detachably connected to said trunk flange stamping; and (e) a locking arrangement for detachably connecting said lower end of each of said side arms with said outer end of one of said bottom arms.

* * * * *